US007814695B1

(12) United States Patent
Keeney et al.

(10) Patent No.: US 7,814,695 B1
(45) Date of Patent: Oct. 19, 2010

(54) COMPOSITE RECEIVER FOR FIREARMS

(75) Inventors: Michael D. Keeney, Rineyville, KY (US); Marlin R. Jiranek, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 329 days.

(21) Appl. No.: 11/969,641

(22) Filed: Jan. 4, 2008

Related U.S. Application Data

(63) Continuation of application No. 10/845,430, filed on May 13, 2004, now abandoned.

(60) Provisional application No. 60/471,266, filed on May 16, 2003.

(51) Int. Cl.
*F41A 21/00* (2006.01)

(52) U.S. Cl. ..... 42/75.01; 42/71.01

(58) Field of Classification Search ..... 42/75.01, 42/71.01, 74, 75.1

See application file for complete search history.

(56) References Cited

U.S. PATENT DOCUMENTS

| | | | |
|---|---|---|---|
| 496,637 | A | 5/1893 | Brown |
| 2,247,011 | A | 6/1941 | Browning |
| 2,455,644 | A | 12/1948 | Barnes |
| 2,594,862 | A | 4/1952 | Browning |
| 2,847,786 | A | 8/1958 | Hartley et al. |
| 2,935,913 | A | 5/1960 | Wilson |
| 3,023,527 | A | 3/1962 | Leek et al. |
| 3,118,243 | A | 1/1964 | Manshel |
| 3,174,851 | A | 3/1965 | Buchler et al. |
| 3,200,710 | A | 8/1965 | Kelly et al. |
| 3,206,885 | A | 9/1965 | Dye |
| 3,380,182 | A | 4/1968 | Browning |
| 3,517,585 | A | 6/1970 | Slade |
| 3,731,418 | A | 5/1973 | Birkenhagen et al. |
| 3,828,417 | A | 8/1974 | Divecha |
| 3,877,167 | A | 4/1975 | Keppeler |
| 3,961,436 | A | 6/1976 | Hagen et al. |
| 3,964,366 | A | 6/1976 | Atchisson |
| 4,012,859 | A | 3/1977 | Johansson et al. |
| 4,061,433 | A | 12/1977 | Chave |
| 4,109,403 | A | 8/1978 | Badali |
| 4,316,339 | A | 2/1982 | Herriott |
| 4,485,721 | A | 12/1984 | Shankhla et al. |
| 4,542,606 | A | 9/1985 | Hoenig |
| 4,596,084 | A | 6/1986 | Martial |

(Continued)

FOREIGN PATENT DOCUMENTS

| | | |
|---|---|---|
| CA | 1167676 | 5/1984 |

(Continued)

OTHER PUBLICATIONS

Letter from Tom Chace to Remington Arms with enclosures (Jan. 6, 2004).

(Continued)

*Primary Examiner*—Michelle Clement
(74) *Attorney, Agent, or Firm*—Womble Carlyle Sandridge & Rice, PLLC

(57) ABSTRACT

A composite receiver for a firearm having a skeletonized body formed from a metal and having a series of ports formed therein. A cover shell is applied over the receiver body to cover and substantially seal the ports.

30 Claims, 3 Drawing Sheets

U.S. PATENT DOCUMENTS

| | | | |
|---|---|---|---|
| 4,601,124 | A | 7/1986 | Brown |
| 4,638,712 | A | 1/1987 | Chawla et al. |
| 4,654,993 | A | 4/1987 | Atchisson |
| 4,685,236 | A | 8/1987 | May |
| 4,722,825 | A | 2/1988 | Goldstein |
| 4,747,225 | A | 5/1988 | Gstettner et al. |
| 4,756,677 | A | 7/1988 | Hribernik et al. |
| 4,893,547 | A | 1/1990 | Atchisson |
| 4,911,060 | A | 3/1990 | Greenspan et al. |
| 5,054,224 | A | 10/1991 | Friar et al. |
| 5,155,291 | A | 10/1992 | Dabrowski |
| 5,160,802 | A | 11/1992 | Moscrip |
| 5,214,234 | A | 5/1993 | Divecha et al. |
| 5,531,150 | A | 7/1996 | Gegaregian et al. |
| 5,600,912 | A | 2/1997 | Smith |
| 5,657,568 | A | 8/1997 | Christensen |
| 5,692,334 | A | 12/1997 | Christensen |
| 5,804,756 | A | 9/1998 | Christensen |
| 5,834,673 | A | 11/1998 | Gustavsson et al. |
| 5,856,631 | A | 1/1999 | Julien |
| 5,900,577 | A | 5/1999 | Robinson et al. |
| 5,907,919 | A | 6/1999 | Keeney |
| 6,158,158 | A | 12/2000 | Wagner |
| 6,189,431 | B1 | 2/2001 | Danner et al. |
| 6,615,702 | B1 | 9/2003 | Julien |

FOREIGN PATENT DOCUMENTS

| | | |
|---|---|---|
| DE | 2225531 | 5/1972 |
| EP | 0235533 | 4/1990 |
| WO | WO 2005/026645 | 3/2005 |

OTHER PUBLICATIONS

International Search Report for PCT/USO4/15335 (Transmitted by the International Searching Authority on May 11, 2006).

COMPOSITE RECEIVER FOR FIREARMS

CROSS-REFERENCE TO RELATED APPLICATION

This application is a continuation of U.S. patent application Ser. No. 10/845,430, filed May 13, 2004, which application is a formalization of a previously filed provisional patent application entitled "Composite Receiver for Firearms" filed May 16, 2003, as U.S. Patent Application Ser. No. 60/471,266 by the inventors named in this patent application, both of which are specifically incorporated herein by reference.

FIELD OF THE INVENTION

The present invention generally relates to firearms, and in particular, to composite receiver for a firearm that generally provides increased strength with lighter weight.

BACKGROUND OF THE INVENTION

The use of lighter weight materials such as aluminum to form parts of a firearm such as a receiver for a rifle or shotgun has increased significantly in recent years. Such lighter weight materials consequently provide the firearm with a reduced weight for ease of carrying, handling, and use in the field. For example, by reducing the weight of a firearm, the user generally is able to manipulate the firearm faster and easier, such as for tracking moving targets such as birds, sporting clays, etc. The lighter weight also means less load that must be born by the user in the field.

A problem with the use of such lighter weight materials, however, has been that such materials typically are not as durable and sacrifice strength and the ability to withstand the extreme pressures and stresses created upon firing a round of ammunition in exchange for lighter weight. For example, in firearms such as gas operated auto loading shotguns in which the action sleeve and bolt are forced rearwardly to an open position where the previously fired cartridge is ejected and the chamber is readied to receive a new round, after which the new round is loaded in the chamber by the capture and back-flow of gases created upon the firing of a round of ammunition, there are extreme chamber pressures and forces resulting from the movement of the bolt that will have to be borne by the receiver of the firearm. Over time, with repeated use, such extreme stresses can cause cracking and potentially failure in lighter weight materials. As a further consequence of using lighter weight materials such as aluminum, in order to meet the stress levels or requirements for the receiver, the receiver typically must be of a significantly increased size and/or profile as compared with conventional steel firearm receivers. Thus, even though the receiver is a lighter weight, its bulk or volume generally must be significantly increased, which can affect the handling and maneuverability of the firearm. Additionally, most lighter weight materials now being used for firearms, such as aluminum, typically are more susceptible to corrosion from exposure to salt, dirt, and other environmental elements during use.

Accordingly, it can be seen that a need exists for a lightweight, high strength receiver for firearms that addresses the foregoing and other related and unrelated problems in the art.

DETAILED DESCRIPTION

Figure 1:
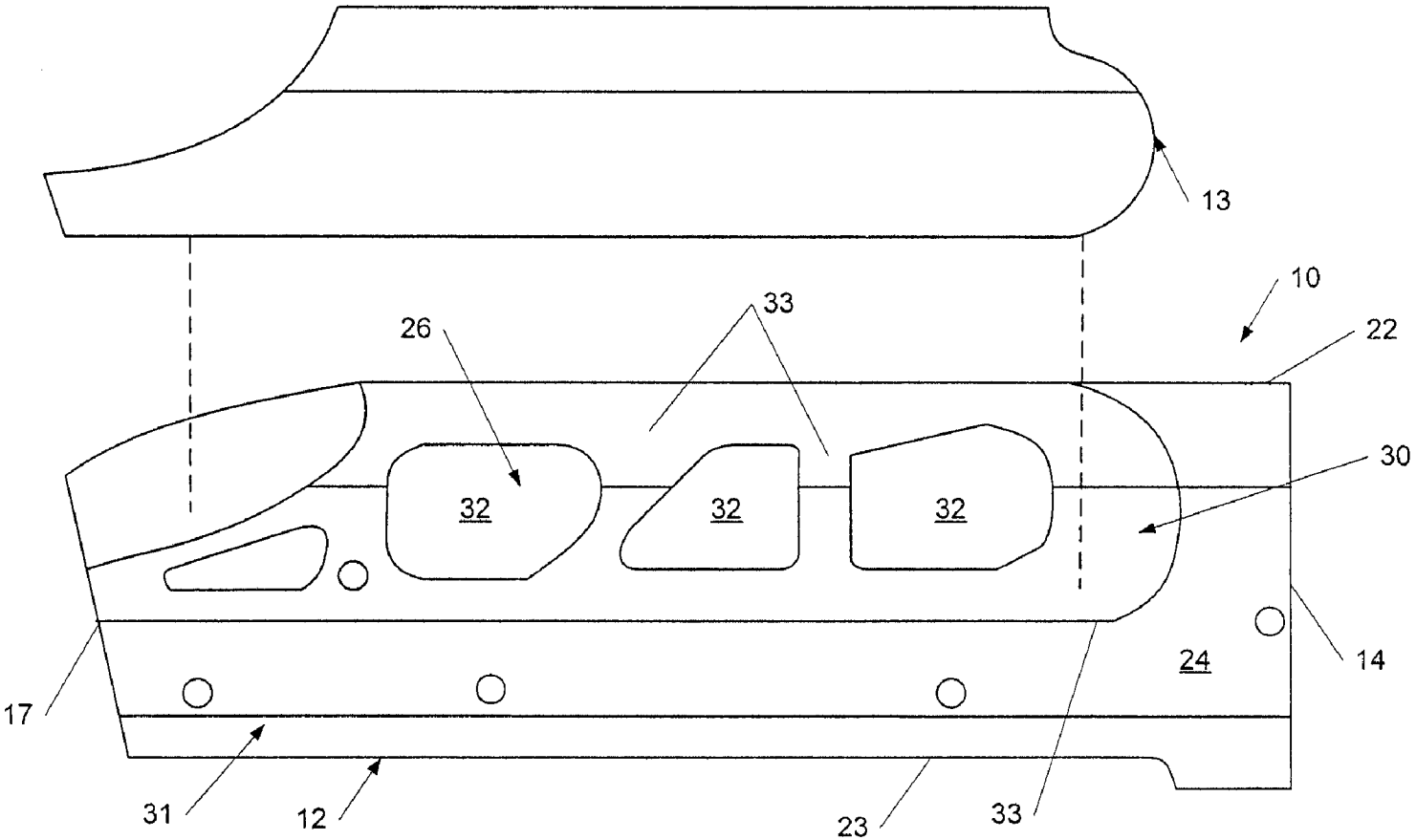
FIG. 1 is a side elevational view illustrating the composite receiver of the present invention.
Figure 2:
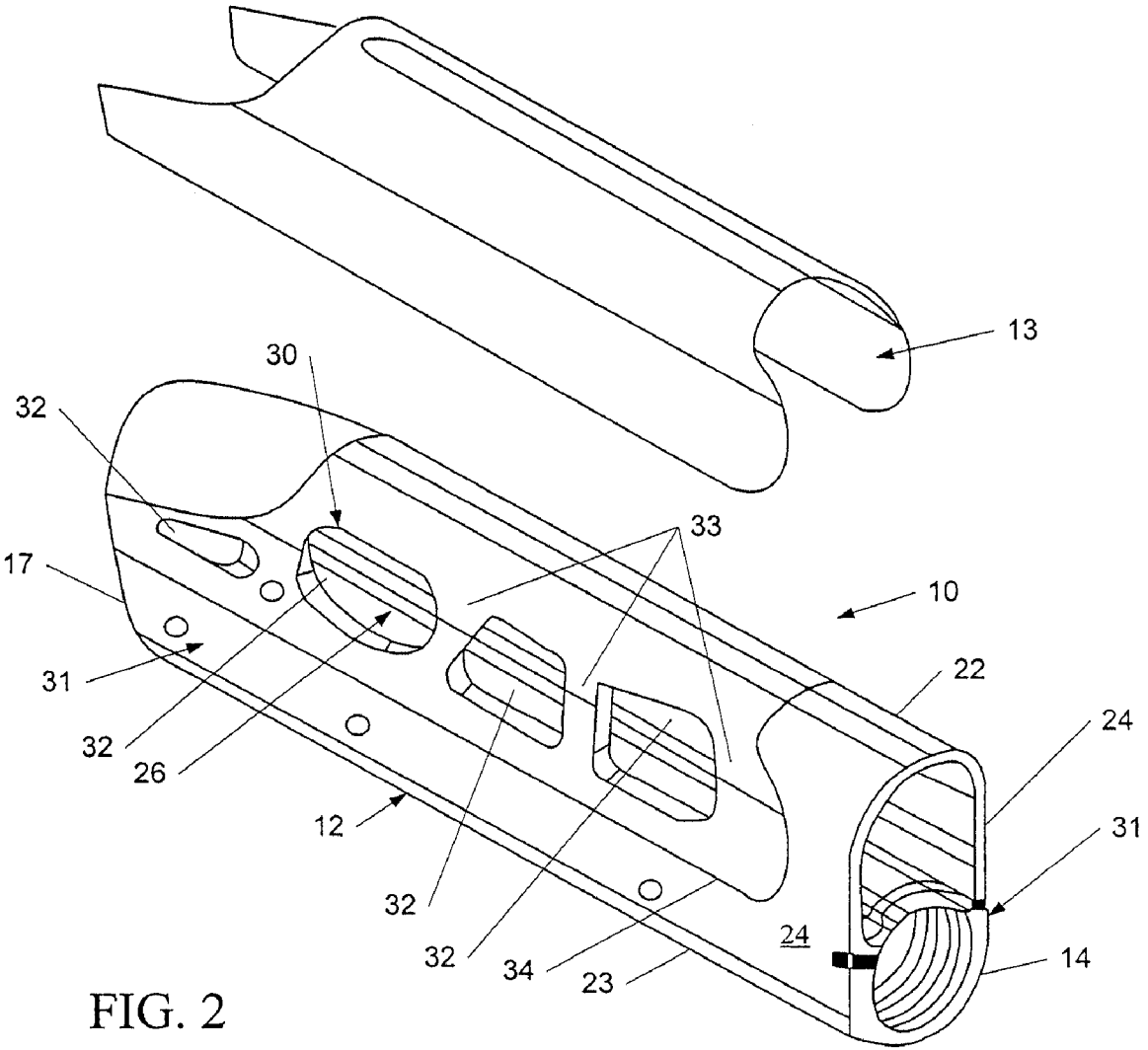
FIG. 2 is an exploded perspective view illustrating the composite receiver of the present invention.
Figure 3:
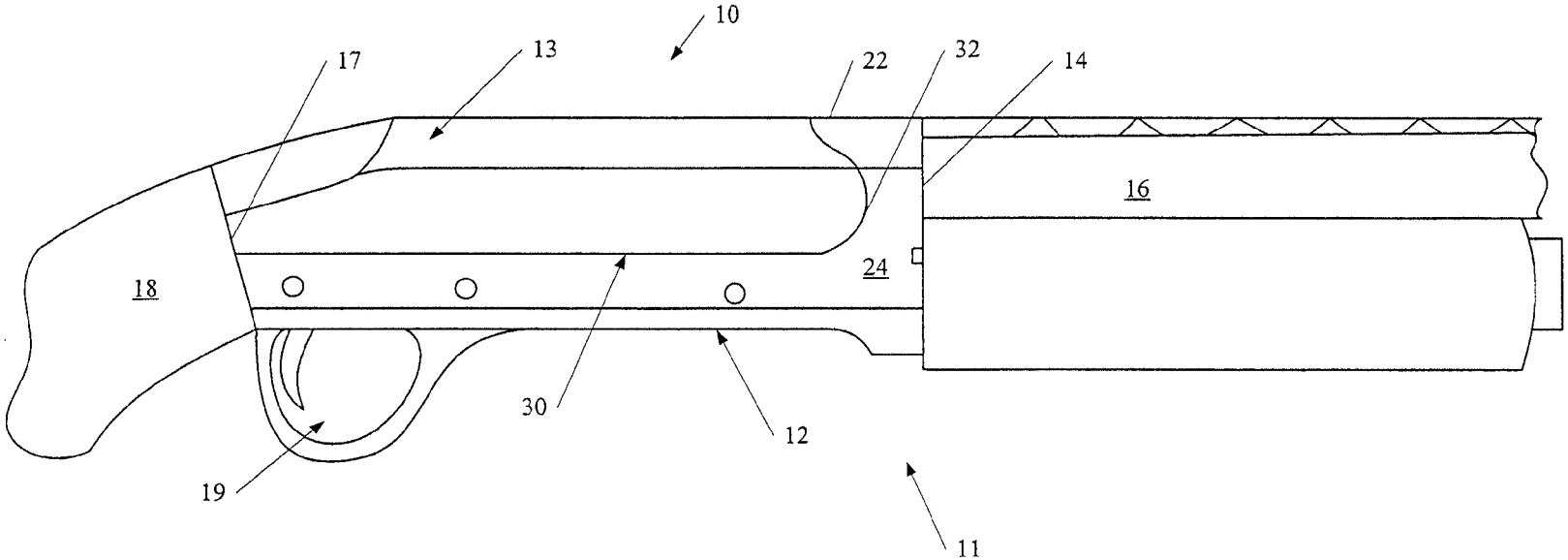
FIG. 3 is a side elevational view illustrating the composite receiver with cover shell attached.

Referring now to the drawings in which like numerals indicate like parts throughout the several views, FIGS. 1-3 illustrate the present invention, which is generally directed to a lightweight, high strength composite receiver system 10 for a firearm 11 (FIG. 3), which has a reduced profile and/or size to facilitate improved handling and maneuverability of the firearm. For purposes of illustration, the present invention has been shown as a receiver for use with a shotgun, such as a gas auto-loading shotgun. However, it will be understood by those skilled in the art that the principles of the present invention also can be applied to the construction of receivers for various other types of firearms including rifles, pump and other types of shotguns and other long guns, as well as for use in the construction of frames for handguns.

As illustrated in the attached FIGS. 1-3, the composite receiver 10 of the present invention generally includes a receiver body 12 over which a shell or cover 13 is provided. The receiver body generally will be formed of a high strength material, typically titanium, which has superior strength characteristics. For example, as compared with aluminum, titanium has a yield strength of approximately 128 kpsi, versus approximately 30-60 kpsi for aluminum and aluminum alloys, and titanium generally has a density of upwards of approximately 0.16 lbs. per cubic inch, versus approximately 0.101 lbs per cubic inch density for aluminum. It further will be understood by those skilled in the art that various other durable, high strength metal materials, such as steel, or metal alloys having similar high strength, durability, and corrosion resistance properties also can be used to form the receiver body.

As shown in FIGS. 2 and 3, the receiver body 12 generally is designed with a structurally optimized geometry and a more slender/smaller profile and/or reduced mass or bulk than conventional light weight receivers, and can be further reduced in size or profile as needed or desired, for increased maneuverability and handling of the firearm. The receiver body 12 includes a first or forward end 14 that connects to the barrel 16 of the firearm 11, as indicated in FIG. 3, and further includes a second or rearward end 17 to which the stock 18 of the firearm is attached, with the trigger or fire control 19 of the firearm positioned adjacent thereto. The receiver body 12 further is skeletonized as shown in FIGS. 1 and 2, with portions cutaway, or removed from the receiver body to provide weight reduction. The skeletonization or reduction of the receiver body is optimized to enable a desired optimal or maximum weight reduction and a reduced profile, while still providing sufficient strength to the receiver body to withstand the stresses and/or forces to which the receiver is subjected upon firing of rounds of ammunition from the firearm. The amount of reduction or skeletonization of the receiver body further generally will vary depending on the type of firearm for which the receiver is being manufactured or constructed.

As illustrated in FIGS. 1 and 2, the receiver body 12 generally includes a top portion or wall 22, lower portion or bottom wall 23, and upstanding sidewalls 24 defining a chamber 26 within which a round of ammunition is passed/manipulated from the magazine to the chamber of the barrel 16 (FIG. 3) of the Firearm 11 for firing. After firing, the spent cartridge is ejected through and from the receiver. As further shown in FIGS. 1-2, a cutaway portion or recessed area or section 30 also is generally formed along the receiver body 12 between the first and second ends 14 and 17 thereof. The cutaway or recessed section 30 generally extends from adjacent lower edge or portion 31 of one sidewall 24, over the top portion 22 of the receiver body, and down to the lower edge of the other sidewall. It will be understood that other shapes or configurations for the recessed or cut away portion 30 can be formed or used as desired.

A series of core or frame spaces, ports, or openings 32 further are formed in the sidewalls 24 of the receiver body 12 as indicated in FIG. 2. The core spaces 32 can be substantially rectangular, oval, trapezoidal, or various other shapes as desired or necessary and will be of a number and size, and will be formed at varying spaced points or locations along the receiver body as a result of structurally optimizing the receiver geometry. The high strength material of the receiver body thus is left intact along those areas, such as indicated at 33 in FIGS. 1-2, where it is necessary to provide support and strength to the receiver to withstand the shock or impact of the movement of the bolt and the other stresses/forces generated upon firing the round of ammunition, while in other areas of the receiver body, material or mass is removed from the body so as to provide a weight savings or reduction.

As additionally shown in FIGS. 1 and 2, the cover shell or shield 13 generally fits over and is applied to the receiver body 12 so as to cover and substantially seal the openings or ports 32 formed in the sidewalls 24 of the receiver body. The cover shell 13 generally is formed from a synthetic or composite material such as carbon fiber or various plastic materials such as nylon, polyvinyl chloride, acetol resins, polyetherethenketones or other similar materials to provide various desired design, stiffening and/or other structural characteristics or properties. For example, in some embodiments, carbon fiber has been used, which provides varying design effects, as well as additional stiffness, durability, and/or other structural or properties to the cover shell and the receiver body. It is further possible to utilize other types of materials such as metals or metal alloys that can be formed into a sheet or shell for covering the ports or openings formed in the receiver body.

As indicated in FIG. 2, the cover shell generally will have a configuration or shape substantially similar to that of the cutaway or recessed section or portion 30 of the receiver body and may be of a thickness so as to generally fit flush within the confines or borders 34 of the cutaway or recessed portion so as to provide the composite receiver with a minimal or reduced overall mass and/or sleek profile without protruding edges that can become caught or which might otherwise interfere with the use of the firearm. The cover shell also can be formed in varying thicknesses, in addition to being formed from various materials, as needed to provide a desired level of stiffness and/or additional structural support to the receiver body. For example, it is possible with the present invention to form the receiver body from aluminum or an aluminum alloy material having a light weight and with a reduced profile, as compared with conventional aluminum receivers that typically are significantly larger in size to provide the required strength to such receivers, utilizing a cover shell of a high strength material that can be formed in a thickness of approximately 0.1 to approximately 1 inch to provide additional support to the receiver body. Alternatively, with higher strength materials, such as titanium, steel or other, similar materials being used for the receiver body, a thinner cover shell, i.e., approximately 0.5-10 mm or less can be used depending on the amount of stiffness and/or structural support desired.

The cover shell typically will be affixed to the receiver body, such as by the use of adhesives such as epoxies or various other types of resins, or can be otherwise attached by welding, fusing or with fasteners such as rivets or protrusions that can engage and catch on recesses formed on the receiver body so as to hold the cover shell in tight, fixed contact therewith. Alternatively, the cover shall can be releasably attached or fastened to the receiver body to enable removal and change out of the cover shell as needed or desired. Once attached to the receiver body, the cover shell will cover and substantially seal the ports or openings 32 formed in the receiver body so as to protect the interior chamber 26 of the receiver body from dirt, moisture and debris.

The cover shell also provides a mechanism or means for customizing the firearm to suit the owner of the firearm. For example, the shell can be formed in various colors or can be formed with various designs or scrollwork applied thereto to allow the firearm to be personalized to suit the desires or requests of a purchaser. In addition, in some embodiments, the cover shell could be removed and/or changed out with cover shells having new/different looks or features as desired by a purchaser to provide different looks or appearances for their firearm with out changing the weight or performance of the firearm. Still further, the materials used for the cover shell can be varied to provide different looks and/or finishes or other decorative effects all of which enable greater flexibility in customizing the design and appearance of the firearm.

Accordingly, the present invention provides a composite receiver having a slender profile or configuration and which is formed from a high strength material so as to provide sufficient strength and enhanced corrosion resistance properties for the receiver, while at the same time provides the firearm with significantly reduced weight similar to conventional light weight firearms using lighter, but less strong and potentially less durable materials. Further, the cover shell, in addition to providing additional stiffness and other structural support properties and substantially sealing the receiver against dirt and debris, further provides a mechanism for enabling the use of varying design features so as to enable more personalization and customization of the appearance of the firearm to suit the desires or tastes of the owner thereof.

It further will be understood by those skilled in the art that while the present invention has been discussed above with reference to preferred embodiments or features, various additions, deletions, modifications and changes can be made thereto without departing from the spirit and scope of the invention.

What is claimed is:

1. A method of forming a high strength, light weight receiver for a firearm, comprising:

forming a metallic receiver body, the receiver body having a top portion, a pair of sidewalls, and a lower portion, wherein a recess is formed at least in the top portion and in the sidewalls, the top portion and the sidewalls at least in part defining a chamber of the receiver, and wherein the top portion of the receiver body is determined with respect to the receiver oriented in an upright firing position;

skeletonizing the receiver body to form a plurality of ports at the recess in the receiver body, with the number and size of the ports selected to provide weight reduction while retaining sufficient strength in the receiver to withstand stresses generated upon firing ammunition; and attaching a cover shell to the receiver body so that the cover shell is accommodated within the recess and covers the ports at the recess in the receiver body.

2. The method of claim 1, wherein the cover shell is made from a synthetic or composite material.

3. The method of claim 2, wherein the cover shell fits flush within borders of the recess.

4. The method of claim 3, wherein attaching the cover shell to the receiver body comprises attaching the cover shell with adhesive.

5. The method of claim 4, wherein the cover shell seals the ports.

6. The method of claim 3, wherein the ports are located at spaced locations along the receiver body.

7. The method of claim 3, wherein forming the receiver body comprises casting or forging the receiver body.

8. The method of claim 3, wherein the recess extends adjacent a lower edge of each sidewall.

9. The method of claim 1, further comprising:

removing the cover shell from the receiver body; and attaching a second cover shell of a different type to the receiver body.

10. The method of claim 1, wherein the cover shell fits flush within borders of the recess.

11. The method of claim 1, wherein the ports comprise at least two ports located at spaced locations along the receiver body.

12. The method of claim 1, wherein forming the receiver body comprises casting or forging the receiver body.

13. The method of claim 1, wherein forming the receiver body comprises forming the receiver body from titanium or steel.

14. The method of claim 13, wherein the cover shell is formed from a material selected from plastic, nylon, carbon fiber, polyvinyl chloride, acetol resins, polyetheretherketone, composites, metals, metal alloys and combinations thereof.

15. A method of forming a high strength, light weight receiver for a firearm, comprising:

forming a metallic receiver body, the receiver body having a top portion, a pair of sidewalls, and a lower portion, wherein the top portion and the sidewalls at least in part define a chamber of the receiver, and wherein the top portion of the receiver body is determined with respect to the receiver oriented in an upright firing position;

skeletonizing the receiver body to form a series of ports at spaced locations in the receiver body, with the number and size of the ports selected to provide weight reduction while retaining sufficient strength in the receiver body to withstand stresses generated upon firing ammunition;

placing a composite cover shell in a position on the receiver body covering the ports in the receiver body; and attaching the cover shell to the receiver body, wherein attaching the cover shell to the receiver body comprises applying adhesive between the cover shell and the receiver body.

16. The method of claim 15, wherein the cover shell is accommodated in a recess formed at least in the top portion and sidewalls of the receiver body.

17. The method of claim 16, wherein the cover shell fits flush within borders of the recess.

18. The method of claim 16, wherein skeletonizing the receiver body to form a series of ports comprises forming at least two spaced ports in each sidewall.

19. The method of claim 16, wherein attaching the cover shell to the receiver body comprises attaching the cover shell with adhesive.

20. The method of claim 16, wherein the cover shell seals the ports.

21. The method of claim 16, wherein the recess extends adjacent a lower edge of each sidewall.

22. The method of claim 15, wherein forming the receiver body comprises casting or forging the receiver body, the receiver body being made from titanium and the cover shell being made from carbon fiber.

23. The method of claim 15, further comprising:

removing the cover shell from the receiver body; and attaching a second cover shell of a different type to the receiver body.

24. A method of forming a high strength, light weight receiver for a firearm, comprising:

forming a metallic receiver body, the receiver body having a top portion, a pair of sidewalls, and a lower portion, wherein the sidewalls and top portion at least in part define a chamber of the receiver, and wherein the top portion of the receiver body is determined with respect to the receiver oriented in an upright firing position;

skeletonizing the receiver body to form a plurality of ports at spaced locations along the receiver body, with the location, number and size of the ports selected to provide an optimal weight reduction of the receiver body while retaining sufficient strength in the receiver to withstand stresses generated upon firing ammunition; and attaching a cover shell to the receiver body so that the cover shell seals the ports in the receiver body.

25. A method of forming a high strength, light weight receiver for a firearm, comprising:

forming a metallic receiver body, the receiver body having a top portion, a pair of sidewalls, and a lower portion, wherein the sidewalls and top portion at least in part define a chamber of the receiver, and wherein the top portion of the receiver body is determined with respect to the receiver oriented in an upright firing position;

skeletonizing the receiver body to form a plurality of ports in the receiver body, with the number and size of the ports selected to provide weight reduction while retaining sufficient strength in the receiver to withstand stresses generated upon firing ammunition;

attaching a cover shell to the receiver body;

removing the cover shell from the receiver body; and attaching a second cover shell of a different type to the receiver body.

26. A method of forming a high strength, light weight receiver for a firearm, comprising:

forming a metallic receiver body, the receiver body having a top portion, a pair of sidewalls, and a lower portion, wherein the sidewalls and top portion at least in part define a chamber of the receiver, and wherein the top portion of the receiver body is determined with respect to the receiver oriented in an upright firing position;

skeletonizing the receiver body to form a plurality of ports in the receiver body, with the number and size of the ports selected to provide weight reduction while retaining sufficient strength in the receiver to withstand stresses generated upon firing ammunition; and attaching a cover shell to the receiver body in a recess formed at least in the top portion, the sidewalls, and the lower portion so that the cover shell seals the ports in the receiver body.

27. The method of claim 26, wherein attaching the cover shell comprises attaching the cover shell to the receiver body using one or more of adhesives, welding, and mechanical means.

28. The method of claim 26, wherein the cover shell is made from a synthetic or composite material and the ports are located at spaced locations along the receiver body.

29. The method of claim 28, wherein the cover shell fits flush within borders of the recess.

30. The method of claim 28, wherein the cover shell is made from carbon fiber and the receiver is made from titanium.

* * * * *